United States Patent [19]

Rittmann et al.

[11] Patent Number: 4,718,127

[45] Date of Patent: Jan. 12, 1988

[54] HELMET VISOR WITH LOCKING HINGE ASSEMBLE

[75] Inventors: Nancy C. Rittmann, Racine; Richard S. Stever; Steven R. Wente, both of Kenosha, all of Wis.

[73] Assignee: Snap-on Tools Corporation, Kenosha, Wis.

[21] Appl. No.: 872,516

[22] Filed: Jun. 10, 1986

[51] Int. Cl.[4] ..... A42B 1/08

[52] U.S. Cl. ..... 2/424; 16/334; 16/330; 16/326

[58] Field of Search ..... 16/334, 344, 329, 330, 16/331, 345, 347, 324, 325, 326, 321, 322, 341; 2/5, 6, 9, 10, 424, 8

[56] References Cited

U.S. PATENT DOCUMENTS

| | | | |
|---|---|---|---|
| 917,768 | 4/1909 | Jordan | 16/325 |
| 1,159,529 | 11/1915 | Parizek | 16/329 |
| 1,180,669 | 4/1916 | Oellrich | 16/334 |
| 1,210,234 | 12/1916 | Towles | 16/334 |
| 1,687,174 | 10/1928 | Mountford | 16/334 |
| 1,885,384 | 11/1932 | Snow | 16/321 |
| 2,635,281 | 4/1953 | Feldberg | 16/329 |
| 3,553,734 | 1/1971 | Aileo | 2/10 |
| 3,797,041 | 3/1974 | Raschke | 2/8 |
| 3,879,146 | 4/1975 | Mayer | 16/325 |
| 3,945,043 | 3/1976 | De Angelis | 2/8 |
| 4,305,160 | 12/1981 | Sundahl | 16/334 |
| 4,571,741 | 2/1986 | Guillaumot | 2/8 |
| 4,571,747 | 2/1986 | Briggs | 2/424 |
| 4,581,775 | 4/1986 | Nava | 2/5 |

FOREIGN PATENT DOCUMENTS

| | | | |
|---|---|---|---|
| 278291 | 10/1927 | United Kingdom | 16/334 |
| 2024000 | 1/1980 | United Kingdom | 16/334 |

*Primary Examiner*—Nicholas P. Godici
*Assistant Examiner*—G. M. Reid
*Attorney, Agent, or Firm*—Emrich & Dithmar

[57] ABSTRACT

A locking hinge assembly for mounting a visor on a helmet includes a cylindrical body which is fixed in an opening in the helmet and is loosely received through an aligned opening in the visor. The body has an annular detent flange with detent recesses therein in which are received detent studs carried by the visor for accommodating movement of the visor among a plurality of discrete detent positions. The locking assembly includes a shaft extending through an axial bore in the body and having an enlarged cam head at the outer end thereof. A cam disk is disposed between the head and the visor and has cam studs which cammingly engage cam recesses in the head. A spring washer is disposed between the cam disk and the visor for urging the detent studs into the recesses to resiliently hold the visor in each detent position and for urging the cam disk against the head. The cam disk responds to manual rotation thereof for axial camming movements toward the visor for frictionally locking it in a selected detent position and away from the visor to release it for movement among its detent positions.

20 Claims, 10 Drawing Figures

HELMET VISOR WITH LOCKING HINGE ASSEMBLE

BACKGROUND OF THE INVENTION

The present invention relates to helmets or other head gear with visors or face shields. The invention relates in particular to the mounting of a visor or face shield on a helmet for movement between open and closed positions.

Many types of helmets, such as those worn by motorcyclists and racing drivers, for example, have a visor or face shield which covers the front face opening of the helmet to protect the wearer's face and eyes. Typically, such visors are formed of a transparent material, such as a suitable plastic, and are typically pivotally mounted on the helmet for movement between open and closed conditions with respect to the front face opening of the helmet.

A number of different types of hinge mechanisms have been utilized for pivotally mounting visors or face shields on helmets. But many of these visors are freely rotatable and can be held in only fully open or fully closed positions.

It is known to provide detent-type hinge mechanisms which will permit the visor to be resiliently retained in a plurality of positions, including positions intermediate the fully open and fully closed positions, with only slight manual force on the visor being necessary to move it from one position to another. But such hinge assemblies which rely on a simple friction detent mechanism, may accidently be moved from a closed position to an open position, such as by excessive wind force, or from an open position to a closed position, such as by sudden shock or the like.

It is known to lock the hinge assemblies, but such locking devices typically use threaded means for tightening the hinge assembly. Such threaded locking means may become loosened in use from vibration or the like.

Furthermore, many prior hinge assemblies have not permitted easy mounting and demounting of the visor from outside the helmet. Such assemblies have either required access to the inside of the helmet to permit the visor to be detached from the hinge assembly, or have required the use of special tools or the like.

SUMMARY OF THE INVENTION

It is a general object of this invention to provide an improved hinge assembly for mounting a visor on a helmet which avoids the disadvantages of prior hinge assemblies, while affording additional structural and operating advantages.

An important feature of the invention is the provision of a hinge assembly of the type set forth, which is of simple and economical construction and which is characterized by ease of installation and use.

Another important feature of the invention is the provision of a hinge assembly which permits the visor to be moved to and be resiliently retained in any of a plurality of different positions.

In connection with the foregoing feature, it is another feature of the invention to provide a hinge assembly of the type set forth which permits the visor to be securely locked in any of its several positions.

Another feature of the invention is the provision of a hinge assembly of the type set forth, which is not subject to loosening in use.

In connection with the foregoing feature, it is another feature of the invention to provide a hinge assembly of the type set forth, which does not utilize threaded fasteners.

Still another feature of the invention is the provision of a hinge assembly of the type set forth, which permits easy mounting and demounting of the visor from outside the helmet.

These and other features of the invention are attained by providing a hinge assembly for mounting a visor on a helmet comprising: first detent means carried by the helmet, second detent means carried by the visor, bias means resiliently urging the first and second detent means into engagement with each other to accommodate rotational movement of the visor about a pivot axis among a plurality of detent positions including a fully closed position and a fully open position, the bias means resiliently retaining the visor in each of the detent positions, and locking means coupled to the first and second detent means and movable between an unlocking condition accommodating movement of the visor among the detent positions and a locking condition cooperating with the first and second detent means for locking the visor in a selected one of the detent positions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
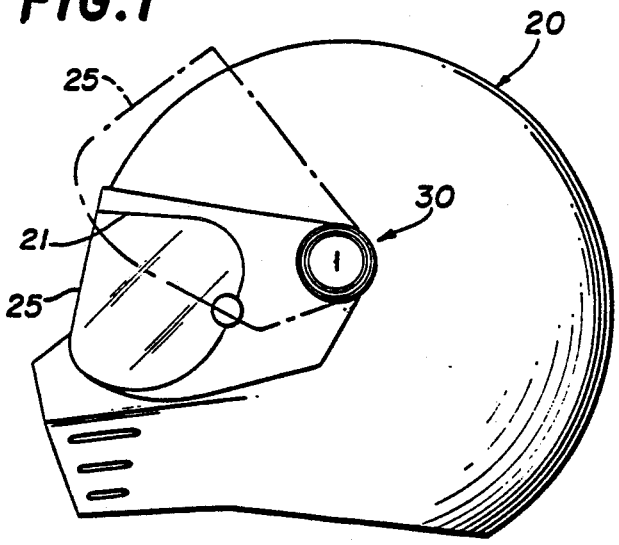
FIG. 1 is a side elevational view of a helmet and visor incorporating the hinge assembly of the present invention.
Figure 2:
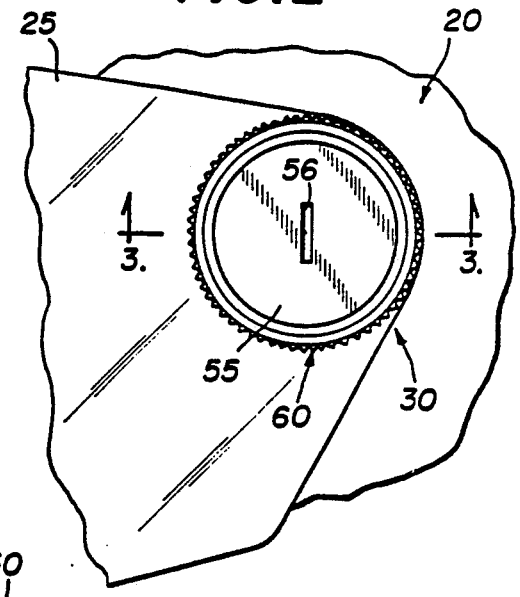
FIG. 2 is an enlarged, fragmentary, side elevational view of the hinge assembly of FIG. 1.
Figure 8:
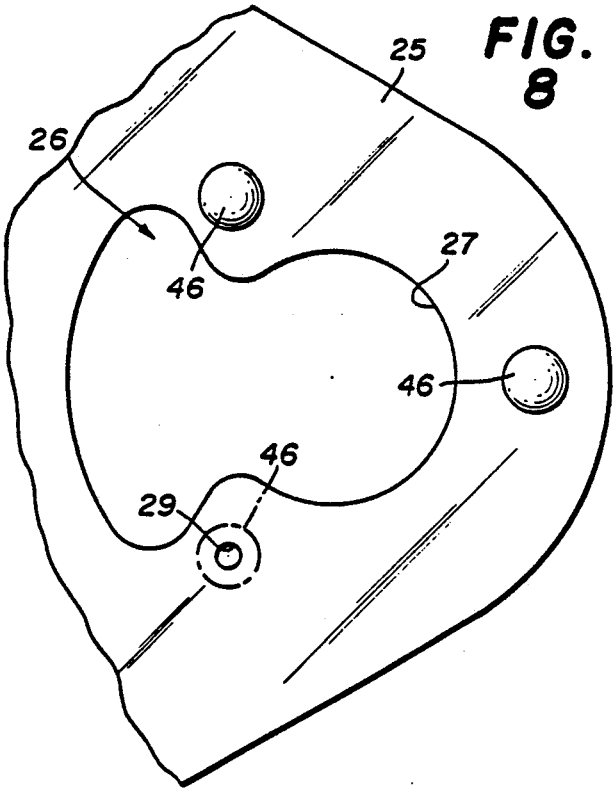
FIG. 8 is an enlarged, fragmentary, side elevational view of the hinge portion of the visor of FIGS. 1 and 2.

Referring to FIGS. 1 and 2, there is illustrated a helmet, generally designated by the numeral 20, having a visor 25 pivotally mounted thereon by means of a hinge assembly 30, constructed in accordance with and embodying features of the present invention. The helmet 20 has a front face opening 21 and is provided on opposite sides thereof with circular hinge openings 22 (one shown, see FIG. 3), disposed rearwardly of the front face opening 21 and preferably aligned substantially coaxially with each other. Each hinge opening 22 is preferably provided with a pair of key slots 23 (see FIG. 4) projecting radially from opposite sides thereof for a purpose to be explained more fully below. The inside of the helmet may be lined with a suitable padding 24 (FIGS. 3 and 4) in a known manner. The visor 25 is formed of a transparent material, such as a suitable plastic, and may be generally U-shaped to wrap around the front portion of the helmet 20. The rear ends of the visor are, respectively, provided with openings 26 (FIGS. 4 and 8), each having a part-circular portion 27, the portions 27 preferably being arranged substantially coaxially with each other for respective alignment, in use, with the hinge openings 22 in the helmet 20. Three stud holes 29 are equiangularly spaced apart around the part-circular portion 27 of the hinge opening 26 for a purpose to be explained more fully below. It will be appreciated that, in use, the visor 25 is pivotally movable about the axis of the hinge openings 26 between a fully closed position, illustrated in solid line in FIG. 1, a fully open position, and a number of intermediate positions, one of which is illustrated in broken line in FIG. 1.

Figure 3:
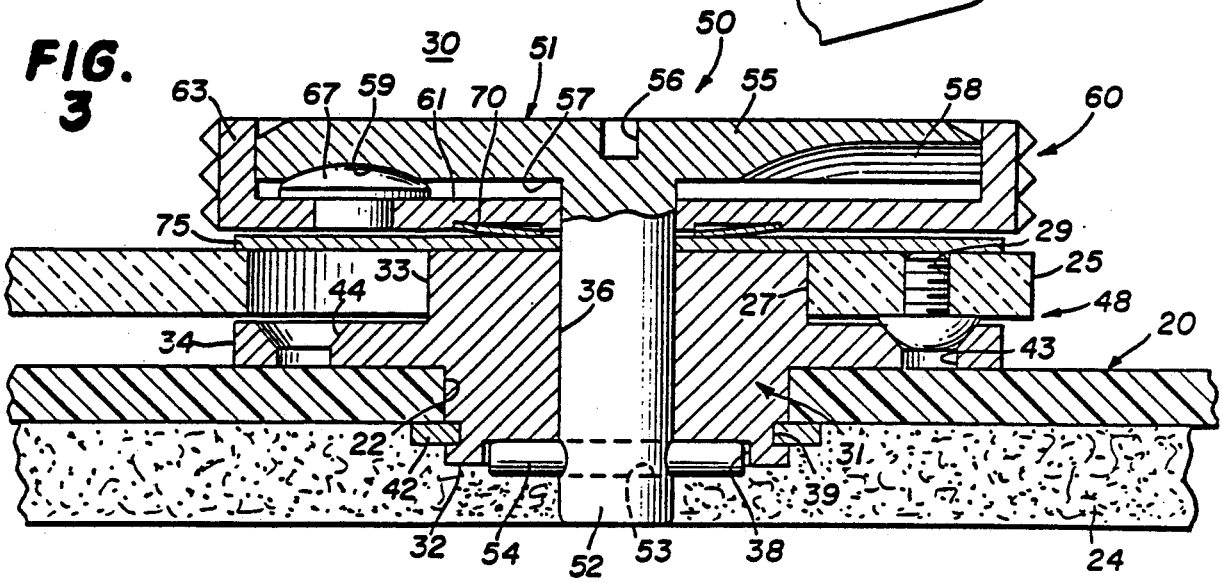
FIG. 3 is a further enlarged fragmentary view in horizontal section taken along the line 3—3 in FIG. 2, and illustrating the hinge assembly in its locked condition.
Figure 4:
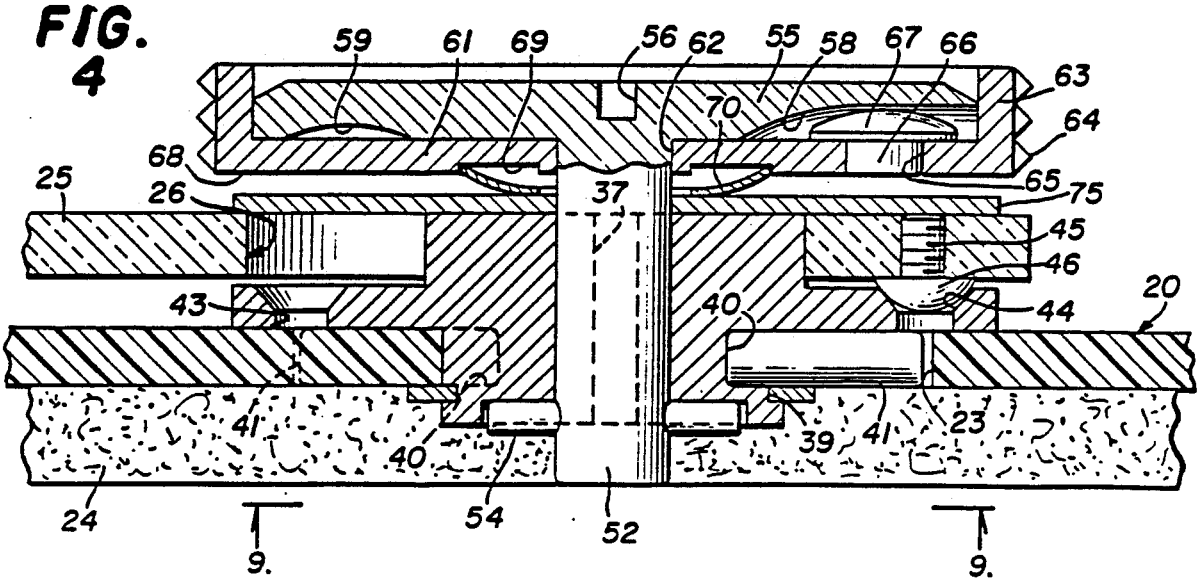
FIG. 4 is a view similar to FIG. 3 and illustrating the hinge assembly in its unlocked condition.
Figure 7:
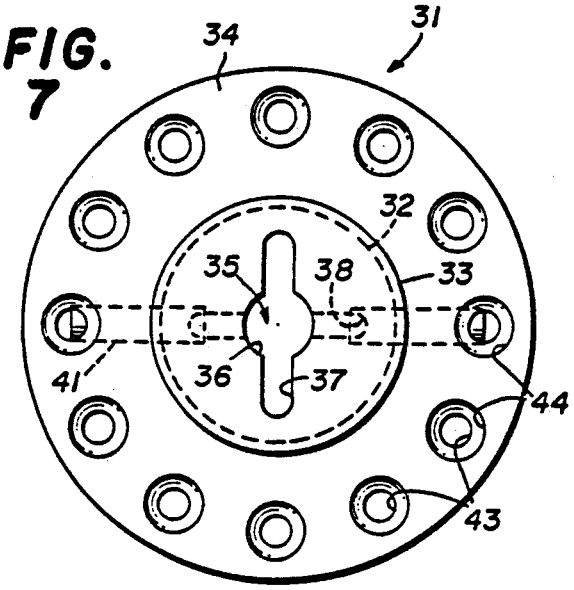
FIG. 7 is a reduced top plan view of the body of the hinge assembly of FIGS. 3 and 4.

Referring now also to FIGS. 3, 4 and 7, the hinge assembly 30 includes a base member 31 having an inner cylindrical portion 32 dimensioned to be snugly received in the hinge opening 22 of the helmet 20, and an outer cylindrical portion 33 dimensioned to be freely received in the part-circular portion 27 of the visor hinge opening 26. Intermediate the inner and outer cylindrical portions 32 and 33 and unitary therewith is a radially outwardly extending annular detent flange 34. Extending axially through the base member 31 coaxially with the inner and outer cylindrical portions 32 and 33 is a bore 35 (FIG. 7) having a circularly cylindrical portion 36 and a diametrical slot portion 37 extending laterally outwardly from opposite sides of the cylindrical portion 36. The inner end of the inner cylindrical portion 32 has an elongated recess 38 formed therein, extending diametrically across the adjacent end of the bore 35 substantially perpendicular to the slot portion 37. A circumferential groove 39 is formed in the outer surface of the inner cylindrical portion 32 and spaced from the annular detent flange 34 a distance very slightly greater than the thickness of the side wall of the helmet 20. The inner cylindrical portion 32 has two diametrically aligned radial bores 40 extending laterally thereinto between the detent flange 34 and the circumferential groove 39 for respectively receiving roll pins 41 in press-fitted engagement therein, so that each of the roll pins 41 projects a predetermined distance radially outwardly beyond the outer surface of the inner cylindrical portion 32.

Figure 9:
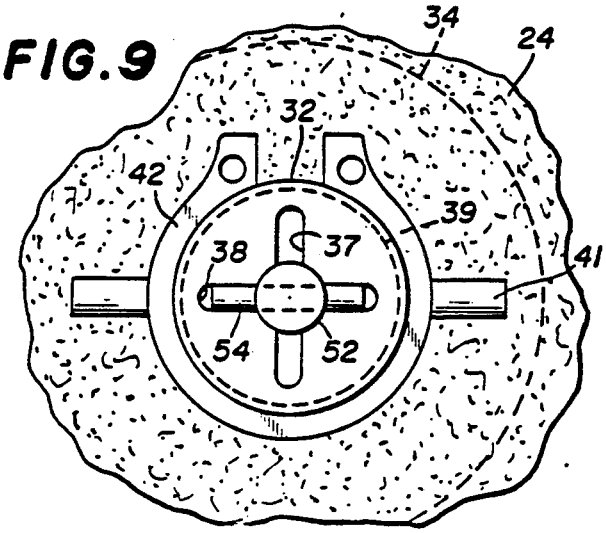
FIG. 9 is a reduced side elevational view of the hinge assembly of FIGS. 3 and 4 as viewed from the inside of the helmet, taken generally along the line 9—9 in FIG. 4 and with the helmet padding partially removed to show the structure.

Referring also to FIG. 9, in use the base member 31 is mounted on the helmet 20 from the outside thereof by inserting the inner cylindrical portion 32 through the hinge opening 22, with the roll pins 41 respectively passing through the key slots 23. A retaining ring 42 is then snap-fitted into the circumferential groove 39 for cooperation with the detent flange 34 securely to grip therebetween the wall of the helmet 20 to prevent removal of the base member 31. The roll pins 41 have a thickness substantially equal to that of the wall of the helmet 20 so that they are confined in the key slots 23, cooperating therewith to prevent rotational movement of the base member 31 with respect to the helmet 20. It will be appreciated that a suitable slit may be formed in the padding 24 so that it may be peeled back to accommodate mounting of the retaining ring 42 and then can be folded back in place thereover.

The detent flange 34 has a plurality of equiangularly spaced apart bores 43 extending therethrough, each having a detent countersink portion 44 at the outer end thereof. Three studs 45 (FIG. 4) respectively have the shanks thereof press-fitted into the stud holes 29 of the visor 25, each of the studs 45 having an enlarged, part-spherical detent head 46 disposed against the inner surface of the visor 25. In use, the part-circular portions 27 of the visor hinge openings 26 are respectively fitted over the outer cylindrical portions 33 of the base member 31, as illustrated in FIGS. 3 and 4. It will be appreciated that the visor 25 is sufficiently flexible to permit separation of the ends thereof to accommodate this mounting. When thus disposed in its mounted condition illustrated in FIGS. 1–4, the visor 25 is rotatable among its several positions about the axis of the base member 31. The spacing of the studs 45 is such that the detent head 46 thereof will simultaneously fit into the countersink portions 44 of the detent bores 43, as illustrated in FIGS. 3 and 4. Thus, it can be seen that the studs 45 cooperate with the detent flange 34 and the bores 43 therein to form a detent structure 48 (FIG. 3).

Figure 6:
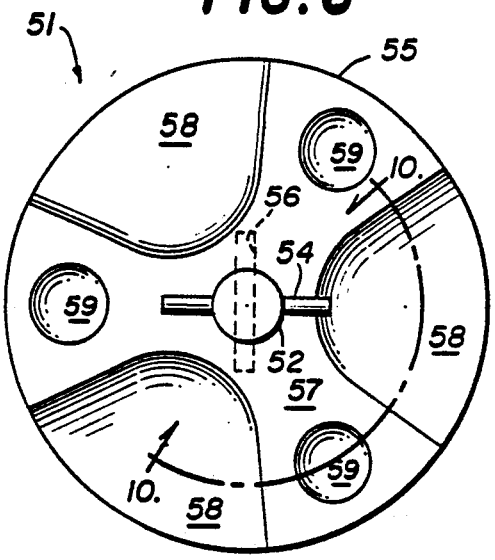
FIG. 6 is a reduced bottom plan view of the fixed cam member of the lock assembly of FIGS. 3 and 4.
Figure 10:
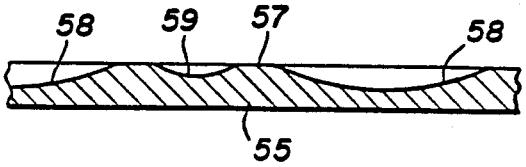
FIG. 10 is an enlarged fragmentary view in vertical section taken along the arc 10—10 in FIG. 6.

Referring now also to FIGS. 6 and 10, the hinge assembly 30 also includes a lock assembly 50, having a fixed cam member 51 and a movable cam member 60. The fixed cam member 51 has an elongated shank 52 having a cylindrical bore 53 (FIG. 3) extending diametrically therethrough adjacent to one end thereof. A roll pin 54 is disposed in the bore 53, with the ends thereof projecting a predetermined distance radially outwardly from the shank 52. The shank 52 is provided at the other end thereof with an enlarged, circular head 55 having a slot 56 formed in the outer surface thereof centrally thereof and extending diametrically substantially perpendicular to the roll pin 54. The head 55 is generally disk-shaped and has a bottom or inner surface 57 having formed therein three equiangularly spaced-apart cam surface recesses 58 and three circular detent recesses 59, alternating with the cam surface recesses 58.

Figure 5:
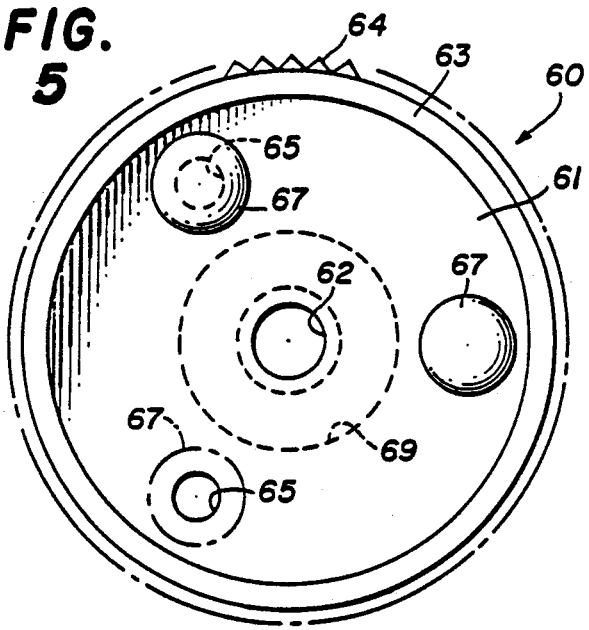
FIG. 5 is a reduced top plan view of the rotatable cam member of the lock assembly of FIGS. 3 and 4.

Referring now also to FIG. 5, the movable cam member 60 has a flat circular base wall 61, having a diameter slightly greater than that of the circular head 55 of the fixed cam member 51 and provided with a central circular bore 62 therein for freely receiving the shank 52 of the fixed cam member 51. Integral with the base wall 61 at the outer periphery thereof and projecting outwardly therefrom around the entire circumference thereof is a cylindrical side wall 63 having an inner diameter slightly greater than the diameter of the circular head portion 55 of the fixed cam member 51. The side wall 63 may be provided with suitable knurling 64 on the outer surface thereof to facilitate manual rotation thereof, as will be explained below. The base wall 61 has three equiangularly spaced-apart circular bores 65 extending therethrough for respectively receiving therein in press-fitted engagement the shanks of three studs 66, each having an enlarged, part-cylindrical cam head 67 at the outer end thereof disposed in use against the outer surface of the base wall 61. The base wall 61 has a bottom or inner surface 68 in which is formed a shallow annular recess 69 surrounding the bore 62 and adapted for receiving therein a spring washer 70. An enlarged spacing washer 75, having an outer diameter slightly less than that of the movable cam member 60, is also provided.

In assembling the lock assembly 50, the shank 52 of the fixed cam member 51 is fitted through the bore 62 in the movable cam member 60, with the side wall 63 and the stud cam heads 67 projecting outwardly, so that the cam heads 67 are respectively receivable in the detent recesses 59 and the side wall 63 encompasses the circular head 55 of the fixed cam member 51. The spring washer 70 is then fitted over the shank 52 and seated in the recess 69, and the washer 75 is then fitted over the shank 52 to hold the spring washer 70 in place. The roll pin 54 is then inserted in the bore 53 in the shank 52 and the shank 52 is then inserted through the bore 35 in the base member 31.

As can be seen in FIG. 4, the spring washer 70 normally resiliently urges the movable cam member 60 and the washer 75 apart. The length of the shank 52 is such as to extend all the way through the base member 31. When the parts are all pushed together so as to compress the spring washer 70, the roll pin 54 will just clear the inner end of the base member 31 and permit the fixed cam member 51 to be rotated a quarter turn to bring the roll pin 54 into alignment with the recess 38. A screwdriver can be used to effect this quarter-turn rotation, utilizing the slot 56 in the circular head 55. When the fixed cam member 51 is then released, the spring washer 70 pushes it outwardly, seating the roll pin 54 in the recess 38 so as to prevent rotational movement of the fixed cam member 51 about the axis of the shank 52. It can be seen that when thus installed in its mounted position, the length of the shank 52 is such that it does not project inwardly beyond the inner surface of the helmet padding 24.

The operation of the hinge assembly 30 will now be explained in detail. Normally, the lock assembly 50 is in an unlocked condition, illustrated in FIG. 4, wherein the cam heads 67 of the studs 66 are respectively received in the cam surface recesses 58 of the circular head 55. The cam surface recesses 58 have a depth sufficient to completely receive the cam heads 67 so that the outer surface of the base wall 61 of the movable cam member 60 is disposed flush against the inner surface 57 of the circular head 55. In this condition, the outer end of the side wall 63 projects a slight distance beyond the outer end of the circular head 55.

In this condition, the spring washer 70 resiliently holds the washer 75 against the visor 25, and thereby holds the visor 25 against the annular detent flange 34 of the base member 31. It will be appreciated that the visor 25 may be disposed in any one of a plurality of discrete detent positions, in each of which the detent heads 46 of the studs 45 are seated in the detent countersink portions 44 of associated detent bores 43, as illustrated at FIGS. 3 and 4. While the spring washer 70 exerts a force sufficient to retain the visor 25 in any one of these detent positions against the force of gravity, it readily yields to manual force exerted on the visor 25 to permit the visor 25 to be rotated to another position. In this regard, it will be appreciated that in moving the visor 25 from one detent position to another, the detent heads 46 of the studs 45 cam up out of the countersink portions 44, slide along the outer surface of the detent flange 34 and drop back into the next countersink portion 44. Thus, it can be seen that the visor 25 undergoes both a rotational and a radial movement with respect to the axis of the base member 31 as it moves from one position to another.

While the spring washer 70 is sufficient to hold the visor 25 in a selected detent position against gravitational forces, it may not be sufficient to hold the visor 25 against certain vibrational or shock forces which may be exerted on the visor 25 in use. Thus, the lock assembly 50 may be moved to a locked condition for positively locking the visor 25 in any selected one of its detent positions, this locking condition being illustrated in FIG. 3. In locking the lock assembly 50, the movable cam member 60 is manually gripped and rotated through about 60°, thereby camming the cam heads 67 up out of the cam surface recesses 58 and along the inner surface 57 of the circular head 55 until the cam heads 67 drop into the shallow detent recesses 59. This rotational movement of the movable cam member 60 causes an axial inward movement thereof as a result of the cam action, against the urging of the spring washer 70 for forcing the washer 75 tightly against the visor 25 and thereby tightly clamping the detent heads 46 in the detent countersink portions 44 to lock the detent structure 48 and effectively prevent rotational movement of the visor 25. It can be seen that in this locked condition, the outer surface of the circular head 55 is substantially flush with the outer end of the side wall 63 of the movable cam member 60. It will be appreciated that, when the cam heads 67 seat in the shallow detent recesses 59, the spring washer 70 produces a slight separation between the washer 75 and the movable cam member 60, but there is still sufficient clamping force securely to hold the visor 25 in the selected detent position.

When it is desired to unlock the lock assembly 50, the movable cam member 60 is again manually rotated about 60° to bring the cam heads 67 back into the cam surface recesses 58 and release the detent structure 48.

An important advantage of the present invention is that it permits locking and unlocking of the hinge assembly with a simple rotational movement of the movable cam member 60, and yet utilizes no threaded connections between any parts, which might be subject to loosening in use. Furthermore, the visor 25 and lock assembly 50 can both be mounted on the helmet 20 from the outside thereof, without the need for any special tools. The hinge assembly 30 provides a unique arrangement, wherein the visor 25 can be moved among a plurality of discrete detent positions, in each of which it is resiliently held in place, and also permits positive locking of the visor 25 in any of these detent positions. In a constructional model of the present invention, the base member 31, the fixed cam member 51 and the movable cam member 60 may be formed of a suitable metal, such as aluminum, and the studs 45 and 66 may be formed of a suitable plastic material, such as nylon.

From the foregoing, it can be seen that there has been provided an improved locking hinge assembly for mounting a visor on a helmet, which permits movement of the visor among a plurality of discrete detent positions, resilient holding of the visor in each of these positions, and positive locking of the visor in any position, all without the use of threaded fastening means and with an assembly which can be installed from outside of the helmet without the use of special tools.

We claim:

1. In combination a helmet; a visor; and a hinge assembly for mounting said visor on said helmet, said hinge assembly including first detent means carried by said helmet, second detent means carried by said visor, bias means resiliently urging said first and second detent means into engagement with each other to accommodate rotational movement of said visor about a pivot axis among a plurality of detent positions including a fully closed position and a fully open position, said bias means resiliently retaining said visor in each of said detent positions, and non-threaded locking means coupled to said first and second detent means and including a portion rotatably movable about said pivot axis between an unlocking condition accommodating movement of said visor among said detent positions and a locking condition cooperating with said first and second detent means for locking said visor in a selected one of said detent positions.

2. The combination of claim 1, wherein said first detent means includes a plurality of recesses, and said second detent means includes a plurality of projections receivable in said recesses.

3. The combination of claim 2, wherein the number of said projections is less than the number of said recesses.

4. The combination of claim 2, wherein said first detent means includes a detent member having said recesses formed therein, said projections comprising studs fixedly secured to said visor.

5. The combination of claim 1, wherein said second detent means is arranged to undergo both rotational and axial movement with respect to said pivot axis as said visor is moved from one to another of said detent positions.

6. The combination of claim 1, wherein said visor and said helmet respectively have aligned openings therethrough, said first detent means including a cylindrical body receivable through said openings, means non-rotatably securing said body to said helmet, said body having a radially outwardly extending annular flange disposed between said visor and said helmet and having a plurality of detent recesses therein circumferentially spaced apart, said second detent means including a plurality of projections carried by said visor and receivable in said recesses, said recesses and said projections respectively defining cam surfaces which are engageable with each other to accommodate rotational movement of said visor about said pivot axis and causing axial movement of said visor in response to said rotational movement.

7. The combination of claim 6, wherein said bias means resiliently urges said second detent means axially into engagement with said detent flange.

8. The combination of claim 6, and further including key means carried by said body and receivable in a key way in said helmet for preventing rotational movement of said body about said pivot axis, and retaining means carried by said body for preventing axial movement thereof with respect to said helmet.

9. In combination a helmet; a visor; a hinge assembly including detent structure for mounting said visor on said helmet for rotational movement about a pivot axis among a plurality of detent positions including a fully closed position and a fully open position; and locking mechanism for said hinge assembly, said locking mechanism including non-threaded first cam means coupled to said detent structure, non-threaded second cam means disposed for rotational movement about said pivot axis with respect to said first cam means, and bias means resiliently holding said first and second cam means in camming engagement with each other, said second cam means being movable between an unlocking condition accommodating rotational movement of said visor among said detent positions and a locking condition cooperating with said detent structure for locking said visor in a selected one of said detent positions.

10. The combination of claim 9, wherein said second cam means undergoes rotational and axial movement with respect to said pivot axis between the locking and unlocking conditions thereof.

11. The combination of claim 9, wherein said first cam means is removably mounted on said detent structure.

12. The combination of claim 9, wherein said first cam means includes a shaft mounted coaxially with said pivot axis and having an enlarged cam head at one end thereof.

13. The combination of claim 12, wherein said second cam means includes a disk-like member disposed between said cam head and said detent structure, said disk-like member having a manually engageable portion at the outer periphery thereof to facilitate rotation thereof.

14. The combination of claim 13, wherein said bias means comprises a spring member disposed between said disk-like member and said detent structure and resiliently urging said disk-like member away from said cam structure.

15. The combination of claim 12, wherein said shaft includes pin means extending diametrically therethrough and engageable with said detent structure for preventing rotation of said shaft about said pivot axis.

16. In combination a helmet; a visor; and a hinge assembly for mounting said visor on said helmet, said hinge assembly including first detent means carried by said helmet, second detent means carried by said visor, bias means resiliently urging said first and second detent means into engagement with each other to accommodate rotational movement of said visor about a pivot axis among a plurality of detent positions including a fully closed position and a fully open position, said bias means resiliently retaining said visor in each of said detent positions, first non-threaded cam means coupled to said first detent means, and second non-threaded cam means disposed for rotational movement about said pivot axis with respect to said first cam means, said bias means being disposed for resiliently holding said first and second cam means in camming engagement with each other, said second cam means being movable between an unlocking condition accommodating rotational movement of said visor among said detent positions and a locking condition cooperating with said first and second detent means for locking said visor in a selected one of said detent positions.

17. The combination of claim 16, wherein said bias means includes a spring member disposed between said second detent means and said second cam means for resiliently urging them apart.

18. The combination of claim 16, wherein said first detent means is removably mounted on said helmet and said first cam means is releasably coupled to said first detent means.

19. The combination of claim 16, wherein said visor and said helmet respectively have aligned openings therethrough, said first detent means including a cylindrical body receivable through said openings, means non-rotatably securing said body to said helmet, said body having a radially outwardly extending annular flange disposed between said visor and said helmet and having a plurality of detent recesses therein circumferentially spaced apart, said second detent means including a plurality of projections carried by said visor and receivable in said recesses, said recesses and said projections respectively defining cam surfaces which are engageable with each other to accommodate rotational movement of said visor about said pivot axis and causing axial movement of said visor in response to said rotational movement.

20. The combination of claim 19, wherein said cylindrical body has an axial bore therethrough, said first cam means including an elongated shaft receivable coaxially through said bore, and an enlarged cam head carried by said shaft at one end thereof and having cam recesses therein, said second cam means including a disk-like member disposed between said head and said second detent means and having cam projections thereon engageable with said cam recesses.

* * * * *

UNITED STATES PATENT AND TRADEMARK OFFICE

CERTIFICATE OF CORRECTION

PATENT NO. : 4,718,127

DATED : January 12, 1988

INVENTOR(S) : Nancy C. Rittmann et al.

It is certified that error appears in the above—identified patent and that said Letters Patent is hereby corrected as shown below:

On the Title Page

[54] "HELMET VISOR WITH LOCKING HINGE ASSEMBLE" should be

--HELMET VISOR WITH LOCKING HINGE ASSEMBLY--.

Signed and Sealed this

Twenty-sixth Day of July, 1988

*Attest:*

DONALD J. QUIGG

*Attesting Officer*

*Commissioner of Patents and Trademarks*